US011002281B2

(12) United States Patent
Pawellek et al.

(10) Patent No.: US 11,002,281 B2
(45) Date of Patent: May 11, 2021

(54) CONTROLLABLE COOLANT PUMP FOR A MAIN DELIVERY CIRCUIT AND A SECONDARY DELIVERY CIRCUIT

(71) Applicant: NIDEC GPM GMBH, Auengrund (DE)

(72) Inventors: Franz Pawellek, Lautertal (DE); Toni Steiner, Bachfeld (DE)

(73) Assignee: NIDEC GPM GMBH, Auengrund (DE)

( * ) Notice: Subject to any disclaimer, the term of this patent is extended or adjusted under 35 U.S.C. 154(b) by 0 days.

(21) Appl. No.: 16/643,009

(22) PCT Filed: Jul. 12, 2018

(86) PCT No.: PCT/EP2018/068958
§ 371 (c)(1),
(2) Date: Feb. 28, 2020

(87) PCT Pub. No.: WO2019/042644
PCT Pub. Date: Mar. 7, 2019

(65) Prior Publication Data

US 2020/0340482 A1 Oct. 29, 2020

(30) Foreign Application Priority Data

Sep. 1, 2017 (DE) ..... 102017120191

(51) Int. Cl.
*F04D 15/00* (2006.01)
*F01P 5/12* (2006.01)
*F01P 7/14* (2006.01)

(52) U.S. Cl.
CPC ..... *F04D 15/0038* (2013.01); *F04D 15/0022* (2013.01); *F01P 5/12* (2013.01);
(Continued)

(58) Field of Classification Search
CPC ..... F04D 13/1215; F04D 13/0011; F04D 13/0016; F04D 13/0022; F04D 13/0027;
(Continued)

(56) References Cited

U.S. PATENT DOCUMENTS 6,612,815 B2 9/2003 Pawellek et al.
6,920,846 B2 7/2005 Pawellek et al.
(Continued)

FOREIGN PATENT DOCUMENTS

CN 101351631 A 1/2009
CN 102149923 A 8/2011
(Continued)

OTHER PUBLICATIONS

International Search Report and Written Opinion for related International Application No. PCT/EP2018/068958, dated Oct. 2, 2018 (8 Pages).
(Continued)

*Primary Examiner* — Kenneth J Hansen
(74) *Attorney, Agent, or Firm* — Ulmer & Berne LLP

(57) ABSTRACT

A mechanically driven coolant pump having a controllable delivery rate for a main delivery circuit from a first outlet and for a secondary delivery circuit from a second outlet of the coolant pump. The coolant pump comprising a hydraulic control circuit which is derived from the coolant pump and has an input-side auxiliary pump, an output-side proportional valve, and a regulating slide for limiting the flow of the main delivery circuit. A cylindrical portion of the regulating slide can be axially displaced in the pump chamber in order to radially shield the pump impeller by means of a pressure in the hydraulic control circuit counter to a restoring force. A regulating valve is connected to the hydraulic control circuit to limit the flow of the secondary delivery circuit, wherein actuations of the regulating slide and of the
(Continued)

Figure 1:
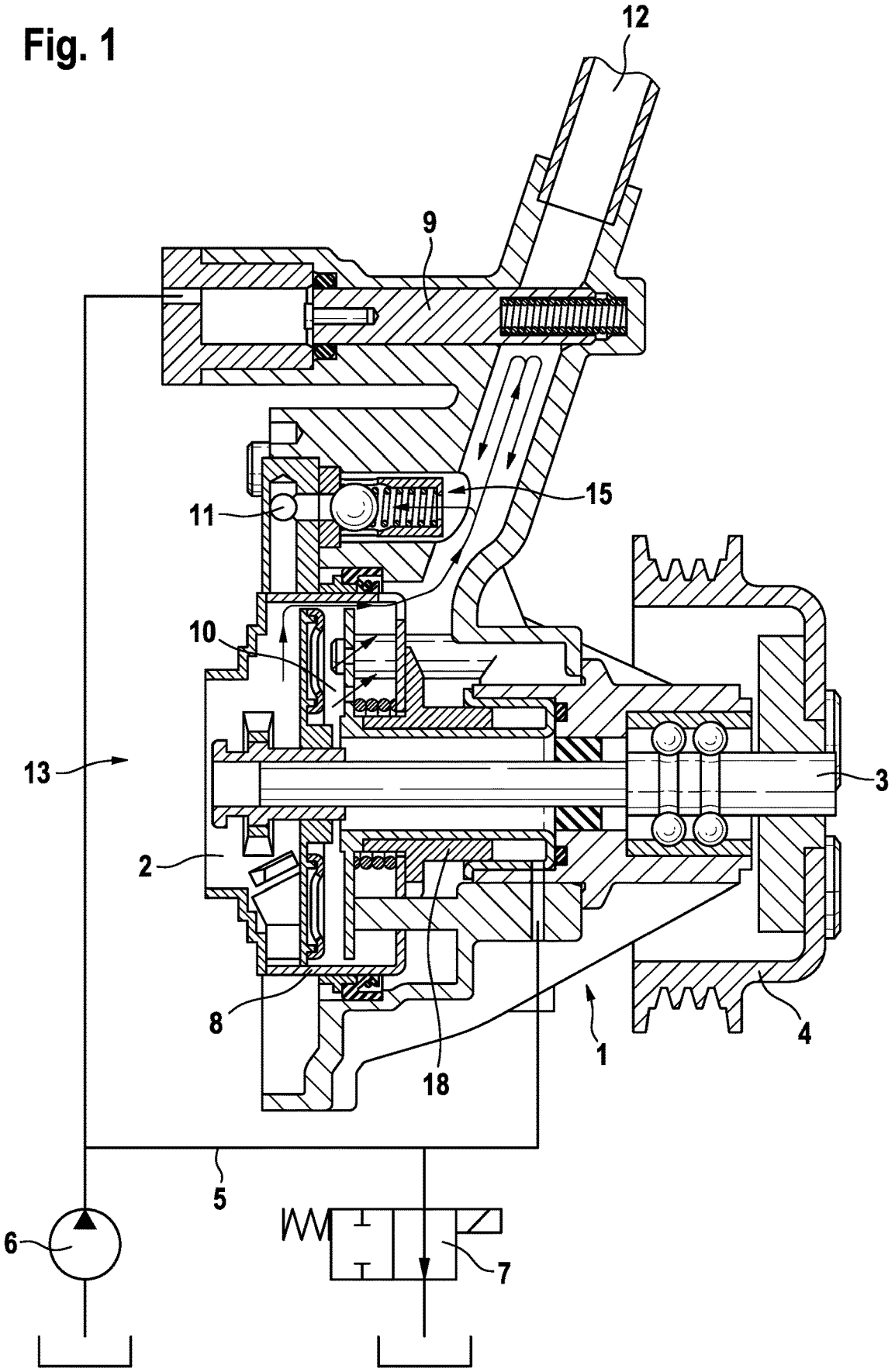

regulating valve are associated with pressure ranges in the hydraulic control circuit.

20 Claims, 3 Drawing Sheets

(52) U.S. Cl.
CPC .... *F01P 2007/146* (2013.01); *F05D 2250/52* (2013.01); *F05D 2270/54* (2013.01)

(58) Field of Classification Search
CPC .... F04D 13/0038; F04D 13/0077; F01P 5/12; F01P 2007/146; F05D 2250/52; F05D 2250/54
See application file for complete search history.

(56) References Cited

U.S. PATENT DOCUMENTS

| | | | |
|---|---|---|---|
| 7,334,543 | B2 | 2/2008 | Pawellek |
| 7,418,951 | B2 | 9/2008 | Hazama |
| 8,038,419 | B2 | 10/2011 | Schmidt et al. |
| 8,628,295 | B2 | 1/2014 | Schmidt et al. |
| 9,080,573 | B2 | 7/2015 | Welte et al. |
| 9,096,207 | B2 | 8/2015 | Madurai Kumar et al. |
| 9,528,521 | B2 | 12/2016 | Pawellek |
| 10,400,659 | B2 | 9/2019 | Hoffmann et al. |
| 2010/0284832 | A1 | 11/2010 | Schmidt et al. |
| 2011/0188987 | A1 | 8/2011 | Schmidt et al. |
| 2012/0076640 | A1 | 3/2012 | Popp et al. |
| 2012/0107121 | A1 | 5/2012 | Schmidt et al. |
| 2012/0291724 | A1* | 11/2012 | Popp ..... F04D 13/12 123/41.08 |
| 2013/0243571 | A1 | 9/2013 | Hurst et al. |
| 2013/0272848 | A1 | 10/2013 | Schmidt et al. |
| 2013/0333863 | A1 | 12/2013 | Pawellek |
| 2014/0147304 | A1 | 5/2014 | Weiss et al. |
| 2014/0212267 | A1* | 7/2014 | Pawellek ..... F04D 15/0022 415/26 |
| 2015/0275742 | A1 | 10/2015 | Chekaiban et al. |
| 2016/0215679 | A1 | 7/2016 | Pawellek |
| 2017/0370274 | A1 | 12/2017 | Hoffmann et al. |
| 2018/0238348 | A1 | 8/2018 | Pawellek et al. |

FOREIGN PATENT DOCUMENTS

| | | | |
|---|---|---|---|
| CN | 202117755 | U | 1/2012 |
| CN | 103946506 | A | 7/2014 |
| CN | 104797794 | A | 7/2015 |
| CN | 105814316 | A | 7/2016 |
| CN | 106536939 | A | 3/2017 |
| DE | 102004012383 | B3 | 6/2005 |
| DE | 102007042866 | A1 | 3/2009 |
| DE | 102010050261 | B3 | 5/2012 |
| DE | 102011079311 | A1 | 1/2013 |
| DE | 102013011209 | B3 | 1/2014 |
| DE | 102015109966 | B3 | 6/2016 |
| WO | 2008043686 | A1 | 4/2008 |
| WO | 2013034126 | A1 | 3/2013 |

OTHER PUBLICATIONS

Office Action for related Chinese Patent Application No. 201880055517.7 dated Mar. 3, 2021 (6 pages).

* cited by examiner

CONTROLLABLE COOLANT PUMP FOR A MAIN DELIVERY CIRCUIT AND A SECONDARY DELIVERY CIRCUIT

The present invention relates to a mechanically driven coolant pump with a controllable delivery rate for a main conveying circuit from a first outlet and for a secondary conveying circuit from a second outlet of the coolant pump.

Due to increasing demands with respect to fuel efficiency and emissions of internal combustion engines, auxiliary devices such as an exhaust gas recirculation system, a turbocharger, an intercooler or the like are used in vehicles, as well as what is called split cooling, i.e., separate cooling of an engine block and cylinder heads of the internal combustion engine. Considering the respective thermal requirements in order to protect the relevant components or preserving the functionality of heat exchangers presents challenges with respect to the flexibility of modern thermal management systems.

In order to provide a greater degree of freedom when designing thermal management, particularly with respect to specific branching and circulation, systems that include one or more auxiliary water pumps in order to enable an independent delivery of individual circulations, and systems with water valves that enable a distribution as required of a coolant flow delivered by a pump in different branches are known in the state of the art.

The increasing complexity of such systems is always confronted with problems with respect to costs of components, installation, packaging, as well as system stability of components relevant for the control.

For example, providing auxiliary water pumps and water valves with actuators for valve adjustment in a branched conduit network is accompanied by corresponding installation, and vulnerability to interference, of wiring for power supply and control signal transmission between decentralized actuators or pump motors, a central control device and a battery. In addition, due to the number and independency of the components, a drive failure or a cable defect may affect other areas of the coolant circulation which do not conform to a uniform fail safe mode for preventing subsequent damage.

From the German patent application DE 10 2010 050 261 B3 of the same applicant, an ECF (Electromagnetic Controlled Flow) coolant pump with a bypass is known. Despite its belt drive, which is dependent on the engine speed, an effective delivery rate may be set in such an ECF pump such that it is throttled with respect to the delivery rate corresponding to the engine speed, or turned off. Even in a mechanically dependent pump drive, functions such as stopping a coolant during a cold-starting phase of an internal combustion engine or the like may thus be realized. The control is carried out by a cylindrical regulating valve, hydraulically actuated by means of a coolant, which covers a flow-effective radial area of the pump impeller. In a closed state, the regulating valve covers the pump impeller against a spiral housing and the pump outlet is thus closed. At the same time, an opening to a bypass in a back wall of the pump chamber behind the pump impeller is unblocked, which enables a discharge, separate from the pump outlet, of coolant from the pump chamber. However, when the regulating valve is in an open position, in which a flow through the pump outlet is completely unblocked, the opening of the bypass to the pump chamber is closed by a part of the regulating valve.

The disclosed coolant pump thus provides a function for switching between a large delivery volume through the pump outlet or a small delivery volume through the bypass. However, while the delivery rate is throttled, intermediate states of a division ratio of the conveying flow occur, the progression of which cannot be separately controlled in a desired way, but which occur as a function of a pressure difference of the individual volume flows, which in turn results from a fixed flow geometry of the pump.

With regard to the disadvantages of the previously mentioned state of the art, it is an object of the present invention to provide compact actuating elements for a coolant system with two conveying circuits.

It is another aspect of the invention to provide a constructional link for a common Fail Safe Mode adopted uniformly in the conveying circuits.

The object is achieved according to the present invention by a coolant pump having the features of claim 1.

The controllable, mechanical coolant pump with a first outlet for a main conveying circuit and a second outlet for a secondary conveying circuit comprises, among other components, a hydraulic control circuit deverted from the coolant with an input-side auxiliary pump, an output.side proportional valve, and a regulating slide as a hydraulic actuator for limiting the flow of the main conveying circuit, and is particularly characterized in that a regulating valve as a hydraulic actuator for limiting the flow of the secondary conveying circuit is connected with the hydraulic control circuit, actuations of the regulating slide and of the regulating valve being associated to respective pressure ranges in the hydraulic control circuit.

The invention provides, for the first time, a coolant pump with two hydraulic actuators, particularly for regulating two different pump outlets or conveying circuits.

The invention furthermore provides, for the first time, connecting two hydraulic actuators, i.e., operating them with the same regulating pressure, to a hydraulic control circuit that is particularly diverted from the coolant.

A subassembly from the state of the art is adopted and expanded as a power supply or an adjustment force of an additional actuator. A particularly compact assembly may thus be achieved by integrating actuating elements in order to regulate the conveying circuits in the pump and saving costs. Particularly external wires to actuators or motors in the coolant-carrying piping network may be dispensed with.

By linking a common, hydraulic actuation by means of the same regulating pressure, the same actuation variable occurs at both actuators even in case of a control failure or a hydraulic defect, which ensures a simultaneously aligned reaction of the actuators, which may be used for a Fail Safe Mode in both conveying circuits.

By setting the actuation of the actuators to different pressure ranges, they react at least partially independently from each other to a control of an allocated pressure in the hydraulic control circuit such that different valve positions may be set at the two conveying circuits. By driving both hydraulic actuators from the hydraulic control circuit, two new principal states may be realized compared to the mentioned state of the art of an ECF pump with a bypass, i.e., in which the main conveying circuit and the secondary conveying circuit are completely closed, or the main conveying circuit and the secondary conveying circuit are completely open, as well as two adjusting ranges in which, for example, the main conveying circuit remains closed and a through-flow of the secondary conveying circuit is settable.

Advantageous further developments of the controllable coolant pumps are the subject to the dependent claims.

According to one aspect of the invention, the regulating valve may be connected to the hydraulic control circuit as a branched-off hydraulic actuator between the auxiliary pump and the proportional valve and may be closed against an elastic pre-tensioning by means of the pressure in the hydraulic control circuit.

Due to this configuration of the hydraulic actuation, the same regulating pressure acts on the hydraulic actuators or the regulating valve and the regulating valve. By configuring the valve as a valve which is open in an unpressurized state, a Fail Safe Mode is achieved for the secondary conveying circuit, as will be explained later.

According to an aspect of the invention, the regulating valve may be configured as a seat valve which is biased by a spring in the opening direction.

Even when receiving a load of the delivery pressure, the seat biased upon by a spring ensures a smooth-running adjustment of the valve body with respect to the positioning force of the spring.

According to one aspect of the invention, a piston surface for receiving a hydraulic positioning force of the regulating valve in the hydraulic control circuit may be smaller than a piston surface of the regulating valve in the hydraulic control circuit.

By selecting these different, hydraulically effective surface sizes of the actuators, an application-specific preference is set in the hydraulic control. In an intermediate range of the regulating pressure, which is between the respective pressures for closing the regulating slide and the regulating valve, a state is thus realized in which the regulating valve for the main conveying circuit remains closed and in which the regulating valve for the secondary conveying circuit is opened in a settable manner. This state is required, for example, when the combustion engine is to reach an operating temperature quickly, while cooling is already required at auxiliary devices such as at a valve of the exhaust gas recirculation system.

According to one aspect of the invention, the surface ratio of the piston surface of the regulating valve to the piston surface of the regulating slide may be approximately 1:3.

Due to this hydraulically effective surface ratio between the two actuators, in conjunction with the reset force of the respective spring pre-tensioning, a preferred spreading of the two associated ranges of the regulating pressure is achieved, which is reflected in a defined response characteristic between the two actuators.

According to one aspect of the invention, the regulating valve may be disposed in the second outlet at the pump housing.

This enables a highly integrated, compact pump assembly and a short hydraulic connection of the hydraulic closed-loop to the regulating valve.

According to one aspect of the invention, between the main conveying flow and the secondary conveying flow, a pressure valve may be provided which opens above a predetermined pressure difference between a higher pressure in the main conveying flow and a lower pressure in the secondary conveying flow.

In a transient state in which the secondary conveying circuit is opened and the main conveying circuit is opened from the closed state, a delivery pressure in the second pump outlet drops considerably due to the large volume flow through the first pump outlet, which results in a corresponding decrease of the volume flow in the secondary conveying circuit despite an unchanged position of the regulating valve.

The pressure valve therefore counteracts an ebbing of the small secondary conveying circuit during the described transient pressure difference, because a part of the main conveying circuit follows into the secondary conveying circuit.

According to one aspect of the invention, the pressure valve may be configured as a check valve biased by a spring in the closing direction.

A check valve biased by a spring is the preferred means for providing a pressure valve that gradually opens to a subsequent flow of the main conveying circuit to the secondary conveying circuit as the pressure difference increases.

According to an aspect of the invention, the pressure valve may open out downstream of the regulating valve into the main conveying circuit and upstream of the regulating valve into the secondary conveying circuit.

This arrangement of the pressure valve achieves, in the described functionality, a preferred response and enables a highly integrated, compact pump assembly.

Figure 2:
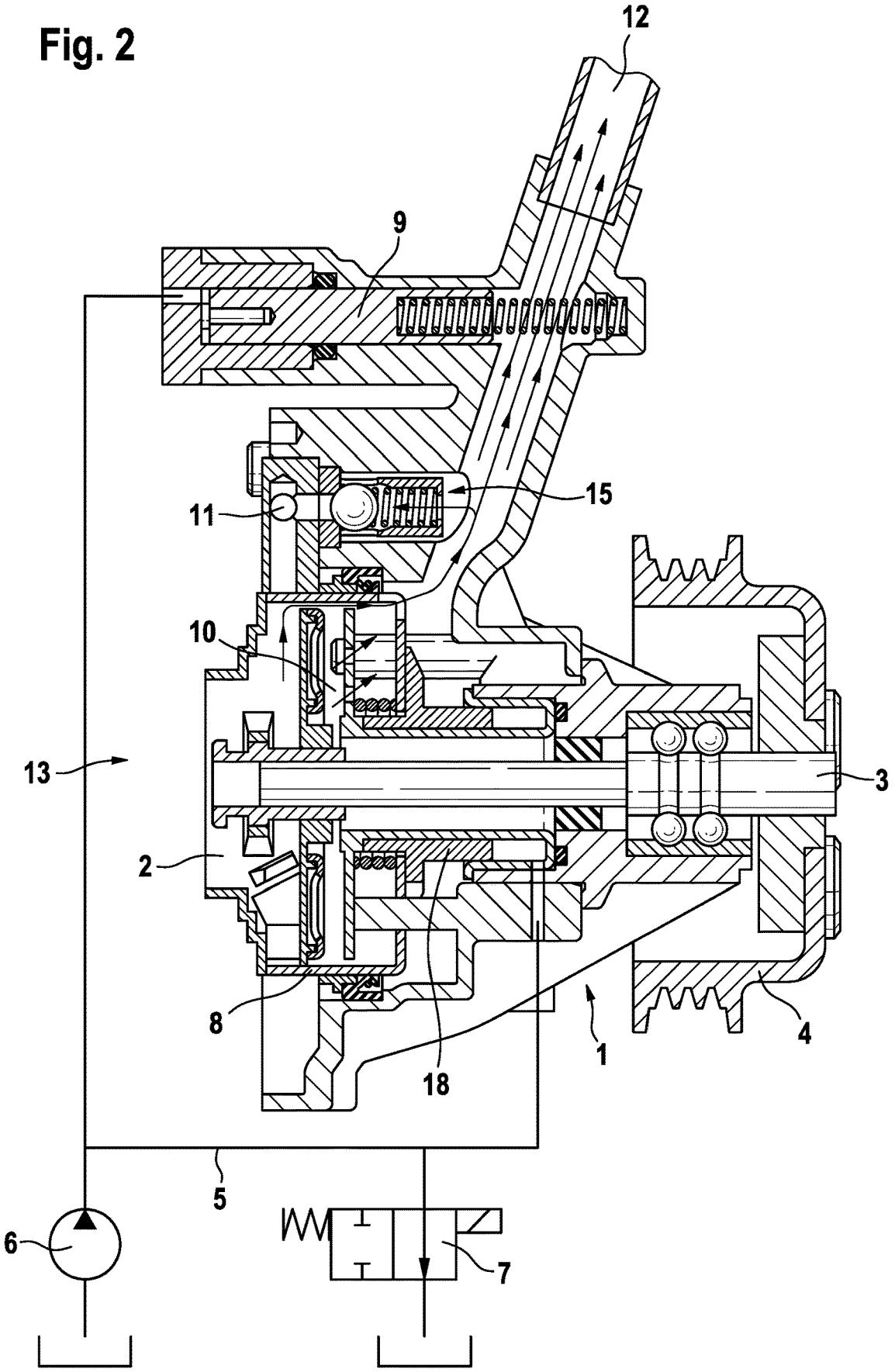
Figure 3:
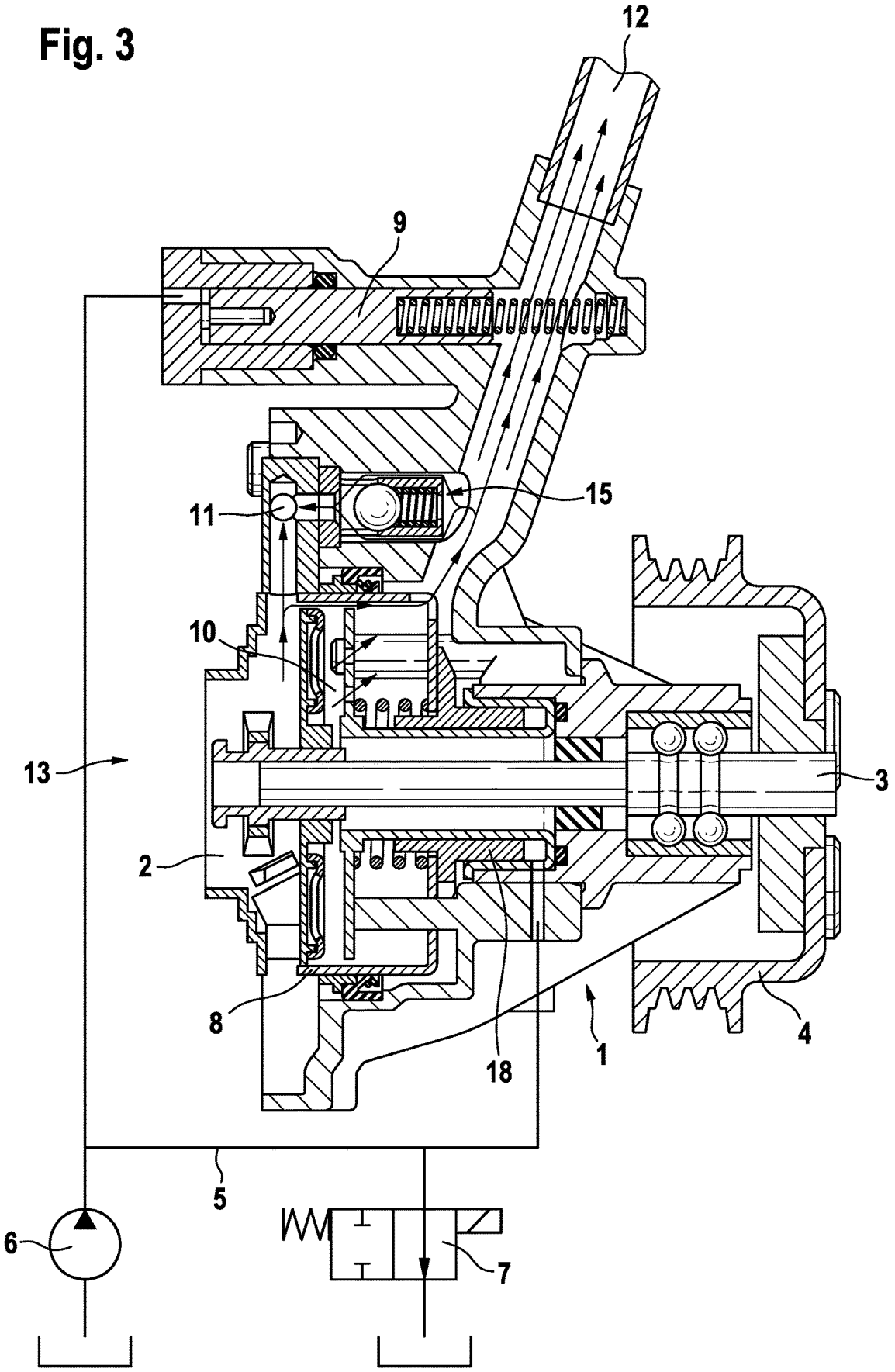

The invention is described below based on an exemplary embodiment with reference to the drawings of the FIGS. 1 to 3. They show:

FIG. 1 an axial sectional view of the pump in a state in which both the main conveying circuit and the secondary conveying circuit are closed;

FIG. 2 an axial sectional view of the pump in a state in which the main conveying circuit is closed and the secondary conveying circuit is opened;

FIG. 3 an axial sectional view of the pump in a state in which both the main conveying circuit and the secondary conveying circuit are opened.

FIG. 1 shows a longitudinal sectional view of the pump without complete outer contours of a pump housing 1. A pump shaft 3 extends from a pulley 4 through a shaft bearing into a pump chamber 10 of the pump housing 1 and drives a pump impeller 2. The pump impeller 2 and the pump chamber 10, which are not fully shown, are structurally configured as a radial pump assembly group in which a pump inlet 13 (not illustrated) axially flows against the pump impeller 2, and in which a first pump outlet 11 for a main conveying circuit connected to the internal combustion engine tangentially discharges out of the pump chamber 10 via an outer spiral housing section.

The pump assembly of the coolant pump has a hydraulically adjustable regulating valve 8 known from what is called an ECF type pump. A flow-effective, radial area around the pump impeller 2 may be variably covered by the regulating slide 8 with a cylindrical section formed coaxially to the pump shaft 3 along a displacement extending in parallel to the pump shaft 3. In FIG. 1, the regulating slide 8 is in a closed position in which the flow area of the pump impeller 2 is completely covered and thus no conveying flow is effected towards the first pump outlet 11.

Furthermore, within the radius of the pump impeller 2 and in parallel to the pump shaft 3, an axial piston pump 6 (shown schematically) is disposed inside of the pump housing 1, the piston of which is actuated by means of a sliding shoe (not illustrated), which slides on a wobble plate (not illustrated) disposed torque proof with the pump shaft 3. The axial piston pump 6 serves as an auxiliary pump of a (schematically shown) hydraulic control circuit 5 operated with a coolant, in which a regulating pressure independent of the conveying flow is generated and set in order to actuate the regulating slide 8 and a regulating valve 9, described later.

The axial piston pump 6 takes in coolant from the flow area between the pump impeller 2 and the regulating valve 9 and discharges the pressurized coolant into the hydraulic control circuit 5 provided in the pump housing 1. The hydraulic control circuit 5 includes an electromagnetically actuated proportional valve 7 (shown schematically) that limits a return-flow of the coolant into the conveyed coolant flow and thus sets a pressure of the hydraulic control circuit 5 over a length between the axial piston pump 6 and the proportional valve 7.

A hydraulic branch-off supplies the pressure of the hydraulic control circuit 5 to an annular piston 18 disposed coaxially to the pump shaft 3 and taking on the function of a hydraulic actuator along the length of displacement of the regulating valve 8. A return spring acts upon the annular piston 18 in a direction opposite to the pressure of the hydraulic control circuit 5, i.e., away from the pump impeller 2. The annular piston 18 is connected to the regulating slide 8 and displaces the same in the direction of the pump impeller 2 as the pressure of the hydraulic control circuit 5 increases, the cylindrical section of the regulating valve 6 thus increasingly axially overlapping the pump impeller 2.

Without a driving current, the electromagnetic proportional valve 7 is open, such that the coolant taken in by the axial piston pump 6 flows essentially unpressurized via the hydraulic control circuit 5 through the proportional valve 7 back to the conveyed coolant. When the electromagnetic proportional valve 7 is temporarily or intermittently closed due to the supply of a driving current controlled by means of pulse width modulation, the pressure generated by the axial piston pump 6 extends across the hydraulic control circuit 5 to the annular piston 18. When the proportional valve 7 remains open due to the driving current being stopped, the hydraulic control circuit 5 no longer pressurizes and the annular piston 18, biased by the return spring, returns to the original position where it is not biased.

In the closed position of the regulating slide 8, illustrated in FIGS. 1 and 2, its cylindrical section completely covers the pump impeller 2 such that essentially no volume flow is effected into the spiral housing, irrespective of the pump speed.

In the open position of the regulating slide 8, shown in FIG. 3, a maximum conveying flow without shielding a flow-effective area of the pump impeller 2 is effected in the main conveying circuit as a function of the pump speed. This state is at the same time a Fail Safe Mode, as, in case of a current supply failure, i.e., an electromagnetic proportional valve 7 without current, a maximum volume flow and a largest possible heat output from the combustion engine via the main conveying circuit is ensured automatically.

In addition, the pump housing 1 includes a second pump outlet 12 for a secondary conveying circuit to which a cooling system for an exhaust gas recirculation valve (EGR valve) is connected in the present exemplary embodiment. The second pump outlet 12 opens at a rear side of the pump impeller 2 into the pump chamber 10. The orifice of the second pump outlet 12 is accessible through frontal openings of the regulating slide 8 irrespective of a position of the same, such that a part of the conveying flow always flows out of the pump chamber 10 into the second pump outlet 12.

The regulating valve 9, which blocks, limits or opens a passage of the secondary conveying circuit, is disposed in the second pump outlet 12. The regulating valve 9 is also connected to the hydraulic control circuit 5 via a hydraulic intersection. A valve body of the regulating valve 9 is displaced by the pressure in the hydraulic control circuit 5 approximately vertically to the direction of flow against the reset force of a spring and thus gradually closes the passage in the second pump outlet 12. When the hydraulic regulating pressure is lower, the valve body of the regulating valve 9 is pushed back by the spring and the passage of the second pump outlet 12 is unblocked.

As explained with respect to the hydraulic driving of the regulating valve 8, the pressure in the hydraulic control circuit 5 is controlled through duty ratios of on/off for opening and closing the proportional valve 7. In order to drive the regulating valve 9 into a variable position for limiting the flow, the pressure is controlled such that a balance is achieved between the hydraulic pressure and a reset force of the pre-stressed spring in the regulating valve 9 and such that a position of the valve body in the regulating valve 9 is maintained.

The positions of the valve body of the regulating valve 9 as well as a position of the annular piston 18 of the regulating valve 8 may also be detected by a position sensor (not illustrated) and used for controlling the proportional valve 7. In this way, a throttling of the main conveying circuit and of the secondary conveying circuit with respect to a predetermined engine speed is carried out by means of a driving current for opening and closing the electromagnetically actuated proportional valve 7.

Below, the setting of two principal states and one adjusting range for limiting the flow will be explained with reference to FIGS. 1 to 3.

In the shown exemplary embodiment, the hydraulic configuration was chosen such that the regulating valve 9 for the secondary conveying circuit requires a higher hydraulic pressure for closing than the regulating valve 8 for the main conveying circuit. The association of the pressure ranges in which the hydraulic actuators respond is set according to a hydraulically effective piston surface, which each actuator comprises for receiving pressure from the hydraulic control circuit 5, and according to the chosen characteristic curve of the return springs. In the shown exemplary embodiment, the response characteristic of the two hydraulic actuators is preferably chosen such that an adjusting range of the regulating valve 9 may be actuated by a pressure beginning above a pressure at which the regulating valve 8 closes completely. When the return springs are selected appropriately, a suitable division between the pressure for closing one hydraulic actuator and the lower pressure at the beginning of the adjusting range of the other actuator is set by a hydraulically effective surface ratio. The surface ratio between the actuator closing at the higher pressure and the actuator closing at the lower pressure is, for example, 1:3.

The operating status shown in FIG. 1 of the controllable coolant pump is intended for a cold start situation of a vehicle in which no cooling of the combustion machine or of other appliances is required yet.

In FIG. 1, the proportional valve 7 is actuated by a control unit (not shown) by means of a duty cycle of a pulse width modulation with a high proportion of on times, in order to set a high pressure in the hydraulic control circuit 5. The proportional valve 7 greatly limits a return flow of the coolant behind the axial piston pump 6, and a back pressure in front of the proportional valve 7 causes the pressure in the hydraulic control circuit 5 to the branched-off actuators to increase, until first the regulating valve 8 and then the regulating valve 9 close. Therefore, once a pressure is maintained, at which the regulating valve 9 closes completely, both passages of the main conveying circuit and of the secondary conveying circuit are maximally limited or closed.

A pressure valve 15 arranged between the first pump outlet 11 and the second pump outlet 12 is closed, as it is exposed to a pressure of the secondary conveying circuit in closing direction which builds up in front of the closed regulating valve 9, while the other side, in a shut-down section of the pump outlet 11 or the spiral housing, is not subjected to a delivery pressure.

The operating status shown in FIG. 2 of the controllable coolant pump is, for example, intended for a warm-up situation of a vehicle, in which the combustion machine is not yet at operating temperature, but so-called hot spots have already formed at an exhaust gas recirculation system so that cooling is already required in order to protect components such as an EGR valve.

In FIG. 2, the proportional valve 7 is actuated by a duty cycle of a pulse width modulation with a lower proportion of on times, in order to decrease the pressure in the hydraulic control circuit 5. A return-flow out of the hydraulic control circuit 5 through the proportional valve 7 increases and the pressure at the actuators decreases. During that process, the regulating valve 9 first returns to the open position via gradual delimiting positions while the regulating valve 8 remains closed. Therefore, when a pressure in the hydraulic control circuit 5 is maintained after this process, the passage of the main conveying circuit remains closed and the passage in the secondary conveying circuit 5 remains open. In addition, when a higher pressure in the control circuit 5 is controlled, a gradual limiting of the secondary conveying circuit is settable when the main conveying circuit is closed.

Meanwhile, the pressure valve 15 remains closed, as it is still subjected to a pressure of the secondary conveying circuit while the other side is not subjected to a delivery pressure.

The operating status shown in FIG. 3 of the controllable coolant pump is intended for a load situation of a vehicle, in which both the internal combustion engine as well as one or more of the other appliances connected to the secondary conveying circuit require cooling.

In FIG. 3, the proportional valve 7 is not actuated or actuated by a duty cycle of a pulse width modulation with a low proportion of on times, such that no pressure is generated in the hydraulic control circuit 5. Subsequently, the regulating valve 8 returns to the open position via gradual delimiting positions while the regulating valve 9, already opened, remains open. As long as no pressure is generated in the hydraulic control circuit 5, both the passage of the main conveying circuit as well as the passage of the secondary conveying circuit 5 remain maximally open. In addition, when a low pressure in the control circuit 5 is controlled, a gradual limiting of the main conveying circuit is settable while the secondary conveying circuit is open.

The pressure valve 15 is opened by a pressure difference during the opening of the regulating valve 8 or during a maximally opened main delivery circuit. The pressure difference is generated by a smaller pressure loss of the part of the conveying flow that flows into the main conveying circuit and a great pressure loss of the part of the conveying flow that flows into the secondary conveying circuit. Consequently, no sufficient volume flow would flow off into the secondary conveying circuit without the pressure valve 15, depending on the flow geometry or flow ratio of the pump outlets 11, 12. As soon as the volume flow of the secondary conveying circuit drops, a corresponding pressure drop in the second pump outlet 12 increases the pressure difference at the pressure valve 15. When the pressure difference exceeds a preset threshold value of the pressure valve 15, the pressure valve 15 opens and enables a subsequent flow out of the large delivery volume into the main conveying circuit in order to compensate for the insufficient delivery volume in the secondary conveying circuit. The flow behavior during a transient state of the division or of a relatively large division ratio between the delivery volumes is thus improved.

The invention claimed is:

1. A controllable coolant pump which is driven mechanically by an internal combustion engine, comprising:

a pump housing with an axially supplying inlet and a radially discharging first outlet for a main conveying circuit which are connected to a pump chamber of the pump housing, a pump impeller for conveying coolant and which is rotatably accommodated on a pump shaft in the pump chamber and is driven via a belt drive, a hydraulic control circuit, with an auxiliary pump on an input side, a proportional valve on an output side and a regulating slide as a hydraulic actuator for limiting a flow of the main conveying circuit, wherein, in order to radially shield the pump impeller, a cylindrical section of the regulating slide is axially displaceable in the pump chamber against a reset force by means of a pressure in the hydraulic control circuit; and a second outlet for a secondary conveying circuit which is connected to the pump chamber; characterised in that a regulating valve, as a hydraulic actuator for limiting a flow of the secondary conveying circuit, is connected to the hydraulic control circuit, wherein actuations of the regulating slide and of the regulating valve are assigned or associated to predetermined respective pressure ranges within the hydraulic control circuit.

2. The controllable coolant pump according to claim 1, wherein the regulating valve, as the hydraulic actuator for limiting the flow of the secondary conveying circuit being a branched-off hydraulic actuator, between the auxiliary pump and the proportional valve is connected to the hydraulic control circuit and is closed against a reset force by means of the pressure in the hydraulic control circuit.

3. The controllable coolant pump according to claim 1, wherein the regulating valve is configured as a seat valve which is biased by a spring in an opening direction.

4. The controllable coolant pump according to claim 1, wherein a piston surface for receiving a hydraulic positioning force of the regulating valve in the hydraulic control circuit is smaller than a piston surface of the regulating slide in the hydraulic control circuit.

5. The controllable coolant pump according to claim 4, wherein a surface ratio of the piston surface of the regulating valve to the piston surface of the regulating slide is approximately 1:3.

6. The controllable coolant pump according to claim 1, wherein the regulating valve is disposed in the second outlet on the pump housing.

7. The controllable coolant pump according to claim 1, wherein there is provided between the main conveying flow and the secondary conveying flow a pressure valve which opens from a predetermined pressure difference between a higher pressure in the main conveying flow and a lower pressure in the secondary conveying flow.

8. The controllable coolant pump according to claim 7, wherein the pressure valve is configured as a check valve which is biased by a spring in a closing direction.

9. The controllable coolant pump according to claim 7, wherein the pressure valve opens out downstream of the regulating slide into the main conveying circuit and upstream of the regulating valve into the secondary conveying circuit.

10. The controllable coolant pump according to claim 2, wherein the regulating valve is configured as a seat valve which is biased by a spring in an opening direction.

11. The controllable coolant pump according to claim 2, wherein a piston surface for receiving a hydraulic positioning force of the regulating valve in the hydraulic control circuit is smaller than a piston surface of the regulating slide in the hydraulic control circuit.

12. The controllable coolant pump according to claim 3, wherein a piston surface for receiving a hydraulic positioning force of the regulating valve in the hydraulic control circuit is smaller than a piston surface of the regulating slide in the hydraulic control circuit.

13. The controllable coolant pump according to claim 2, wherein the regulating valve is disposed in the second outlet on the pump housing.

14. The controllable coolant pump according to claim 3, wherein the regulating valve is disposed in the second outlet on the pump housing.

15. The controllable coolant pump according to claim 4, wherein the regulating valve is disposed in the second outlet on the pump housing.

16. The controllable coolant pump according to claim 5, wherein the regulating valve is disposed in the second outlet on the pump housing.

17. The controllable coolant pump according to claim 2, wherein there is provided between the main conveying flow and the secondary conveying flow a pressure valve which opens from a predetermined pressure difference between a higher pressure in the main conveying flow and a lower pressure in the secondary conveying flow.

18. The controllable coolant pump according to claim 3, wherein there is provided between the main conveying flow and the secondary conveying flow a pressure valve which opens from a predetermined pressure difference between a higher pressure in the main conveying flow and a lower pressure in the secondary conveying flow.

19. The controllable coolant pump according to claim 4, wherein there is provided between the main conveying flow and the secondary conveying flow a pressure valve which opens from a predetermined pressure difference between a higher pressure in the main conveying flow and a lower pressure in the secondary conveying flow.

20. The controllable coolant pump according to claim 5, wherein there is provided between the main conveying flow and the secondary conveying flow a pressure valve which opens from a predetermined pressure difference between a higher pressure in the main conveying flow and a lower pressure in the secondary conveying flow.

* * * * *